US005841310A

United States Patent [19]

Kalthoff et al.

[11] Patent Number: 5,841,310

[45] Date of Patent: Nov. 24, 1998

[54] CURRENT-TO-VOLTAGE INTEGRATOR FOR ANALOG-TO-DIGITAL CONVERTER, AND METHOD

[75] Inventors: Timothy V. Kalthoff; James L. Todsen, both of Tucson, Ariz.

[73] Assignee: Burr-Brown Corporation, Tucson, Ariz.

[21] Appl. No.: 835,776

[22] Filed: Apr. 8, 1997

[51] Int. Cl.[6] ..... G06G 7/64

[52] U.S. Cl. ..... 327/337; 327/341; 327/345; 327/561; 341/172

[58] Field of Search ..... 327/337, 341, 327/336, 345, 362, 561; 341/118, 155, 172

[56] References Cited

U.S. PATENT DOCUMENTS

| | | | |
|---|---|---|---|
| 4,393,351 | 7/1983 | Gregorian et al. | 327/337 |
| 4,438,354 | 3/1984 | Haque et al. | 327/337 |
| 4,567,465 | 1/1986 | Komiya | 340/347 AD |
| 4,688,017 | 8/1987 | Huebner et al. | 340/347 |
| 4,772,871 | 9/1988 | Suzuki et al. | 341/155 |
| 4,896,156 | 1/1990 | Garverick | 341/143 |
| 4,901,031 | 2/1990 | Kalthoff et al. | 330/253 |
| 4,988,900 | 1/1991 | Fensch | 327/337 |
| 5,027,116 | 6/1991 | Armstrong et al. | 341/120 |
| 5,142,286 | 8/1992 | Ribner et al. | 341/143 |
| 5,172,117 | 12/1992 | Mills et al. | 341/157 |
| 5,274,375 | 12/1993 | Thompson | 341/143 |
| 5,351,050 | 9/1994 | Thompson et al. | 341/143 |
| 5,500,645 | 3/1996 | Ribner et al. | 341/143 |
| 5,565,867 | 10/1996 | Tiemann | 341/143 |
| 5,579,247 | 11/1996 | Kerth et al. | 364/571 |

FOREIGN PATENT DOCUMENTS

| | | | |
|---|---|---|---|
| 0328318 | 8/1989 | European Pat. Off. | 341/143 |
| 0396786 | 11/1990 | European Pat. Off. | 341/143 |
| 0615344 | 9/1994 | European Pat. Off. | 341/143 |
| 62-277819 | 12/1987 | Japan | 341/143 |
| 63-246929 | 10/1988 | Japan | 341/143 |
| 2-266718 | 10/1990 | Japan | 341/143 |
| 6-120837 | 4/1994 | Japan | 341/143 |

*Primary Examiner*—Timothy P. Callahan
*Assistant Examiner*—Jung Ho Kim
*Attorney, Agent, or Firm*—Cahill, Sutton & Thomas P.L.C.

[57] ABSTRACT

An integrating circuit includes an operational amplifier and an integrating capacitor which is decoupled from the output of the operational amplifier and precharged to a positive reference voltage before each integration cycle. During each integration cycle the operational amplifier output decreases from the reference voltage toward but not below ground. This allows the operational amplifier to be included as a front-end integrator to a delta-sigma analog-to-digital converter that is powered only by a single power supply. In the described embodiment, the output is coupled to an input of an auto-zeroing stage which provides negative feedback to stabilize the operational amplifier when the integrating capacitor is disconnected during precharging and a bandwidth control input which couples a larger compensation capacitance to reduce the bandwidth during integration to reduce RMS noise. In the described embodiment, a correlated double sampling capacitor is discharged to zero while the integrating capacitor is precharged and kT/C error and charge injection error voltages of opposite polarity are stored on both the integrating capacitor and the correlated double sampling capacitor. The correlated double sampling capacitor is switched into the feedback of the operational amplifier in series with the integrating capacitor to automatically cancel the error voltages and present a more accurate input to the delta-sigma analog-to-digital converter.

16 Claims, 5 Drawing Sheets

40
39
G
BNC
52
56

63
40
59
53
52
MA1
54
62
57
56
58
55
61
60
49
VB2
+VREF
AZA
34-1
31-1
+VDD
(+)
64
51
65
AZA
(-)
33-1
31-2
27-1
(-)
VB1
50
28-1
(+)
7-1

CURRENT-TO-VOLTAGE INTEGRATOR FOR ANALOG-TO-DIGITAL CONVERTER, AND METHOD

CROSS REFERENCE TO RELATED APPLICATION

This application is related to the corresponding assigned application "CAPACITOR ARRAY HAVING USER-ADJUSTABLE, MANUFACTURER-TRIMMABLE CAPACITANCE AND METHOD" by James L. Todsen and Timothy V. Kalthoff, filed simultaneously herewith and incorporated herein by reference.

BACKGROUND OF THE INVENTION

The invention relates to current-to-voltage integrators, and improvements therein which allow operation from a unipolar (i.e., single) power supply, and further to improvements in such a current-to-voltage integrator for reducing charge injection errors and kT/C errors due to switching of capacitors, and more particularly to use of such a current-to-voltage integrator as a front-end integrator with an analog-to-digital converter that is operable from a single power supply.

In prior art integrating amplifiers, (e.g., in various analog integrators and switched capacitor integrators) integrating capacitors are "reset", i.e., discharged to zero volts, at the beginning of each integrating cycle. Referring to FIG. 2, this usually is accomplished by closing a switch 35 to short-circuit the two terminals of an integrating capacitor 36. A consequence of the known technique of resetting integrating capacitors to zero volts is that an input current (such as a photocurrent produced by a photosensor) that flows into the inverting input of operational amplifier 37 in FIG. 2 causes the output thereof to decrease to voltage levels below the reference voltage (e.g., ground) applied to the non-inverting input of operational amplifier 37. Two power supplies therefore must be provided, one typically providing +5 volts and a ground reference voltage, and the other providing a negative supply voltage.

It would highly desirable for the integrating current-to-voltage converter to be powered from only a single power supply, such as a +5 volt power supply. It also would be highly desirable for an entire functional circuit of which the integrating current-to-voltage converter is a component (for example, as a front-end integrator for an analog-to-digital converter) to be operable from only a single 5 volt power supply. This would provide a great, previously unachievable advantage for prospective customers of such products.

Error correcting techniques accomplished by use of correlated double sampling capacitors are known for storing charge representing kT/C error voltages (which are inherently produced on a capacitor when it is operatively disconnected from a circuit by opening a switch), to cancel the effect of such kT/C error voltages on the output of the integrating circuit. This technique has been used to reduce kT/C errors in an open loop circuit outputting signals from a CCD (charge coupled device) array through a buffer to the input of an analog-to-digital converter.

U.S. Pat. No. 5,027,116 (Armstrong et al.) discloses performing an auto-zeroing function differentially, applying both outputs back to the two corresponding auto-zeroing inputs, respectively.

SUMMARY OF THE INVENTION

Accordingly, it is an object of the invention to provide a current-to-voltage integrator which is operable from only a single power supply, such as a 5 volt power supply.

It is another object of the invention to provide such a current-to-voltage integrator as a front-end integrating amplifier to an analog-to-digital converter wherein the entire circuit, including both the integrator and the analog-to-digital converter, is operable from only a single low voltage power supply.

It is another object of the invention to provide an integrating current-to-voltage converter which is operable from only a single power supply and which provides automatic cancellation of kT/C errors and charge injection errors on the integrating capacitor using a correlated double sampling capacitor.

It is another object of the invention to provide a low cost analog-to-digital converter having a front-end current integrator which provides faster settling times of the front-end current integrator during output sampling by an analog-to-digital converter than has been achieved in the prior art.

It is another object of the invention to provide a low cost multiple channel data acquisition system including multiple front-end integrators the output of which are multiplexed into a single analog-to-digital converter, which provides faster settling of the front-end integrators during analog-to-digital conversion and hence faster overall system conversion times, including the settling times of the front-end integrators, than has been achieved in the prior art.

Briefly described and in accordance with one embodiment thereof, the invention provides an integrating circuit including an operational amplifier (7-1) having an inverting input, an output, and a non-inverting input coupled to a first reference voltage conductor conducting a first reference voltage, an integrating capacitor ($C_{INT1}$) having a first terminal coupled to the inverting input and a second terminal coupled to the output, first switching circuitry (10-1) coupled between the output and the second terminal and operative to decouple the output from the integrating capacitor during precharging of the integrating capacitor. A first conductor (46) conducts a precise second reference voltage ($+V_{REF}$). Second switching circuitry (11-1 & 45) coupled between the first voltage conductor and the second terminal is operative to couple the second terminal to the second reference voltage ($+V_{REF}$) during precharging of the integrating capacitor. Third switching circuitry (8-1) coupled between the first reference voltage conductor and the first terminal is operative to connect the first terminal (27-1) to the first reference voltage during the precharging. The precharging occurring before an integration cycle including decoupling the first terminal from the first reference voltage, decoupling the second terminal from the second reference voltage, coupling the output to the first terminal (40), and conducting an input current into the inverting input (27-1). During integration the operational amplifier decreases its output voltage from the second reference voltage as necessary to maintain the inverting input (27-1) at the first reference voltage. In one embodiment, the integrating circuit is powered only by a single power supply. The output of the operational amplifier (7-1) is fed back to an inverting input of an auto-zeroing stage (51) thereof to stabilize the operational amplifier during the precharging. The auto-zeroing stage also has a non-inverting input coupled to the reference voltage to cause the output (4) of the operational amplifier output to be at the reference voltage at the beginning of the next integration cycle.

In the described embodiment a correlated double sampling capacitor (16-1) includes a third terminal is coupled to the second terminal and also includes a fourth terminal. Fourth switching circuitry (11-1, 45, 13-1) is coupled between the third terminal and a fourth terminal and is operative to discharge the correlated double sampling capacitor to zero volts during the precharging of the integrating capacitor. Fifth switching circuitry (14-1) is coupled between the fourth terminal and the output and is operative to connect the correlated double sampling capacitor in series with the integrating capacitor after the integration cycle is complete to cancel an opposite polarity reset error voltage stored on both the integrating capacitor and the correlated double sampling capacitor and thereby cause the operational amplifier to produce an output voltage that more accurately represents the input current over the integrating cycle.

The operational amplifier includes a first internal compensation capacitor (52) coupled between the output and a point in an internal signal path. The operational amplifier also includes a second internal compensation capacitor (53) and fourth switching circuitry (54) coupled in series between the output and a point in the internal signal path, to reduce the bandwidth of the operational amplifier when the fourth switching circuitry is operative to couple the second compensation capacitor in parallel with the first. The integrating capacitor includes a programmable array of capacitors which can be selectively coupled in parallel in response to a plurality of gain selection inputs to thereby control the gain of the integrating circuit. The output is coupled to an inverting input of a differential delta-sigma analog-to-digital converter having a non-inverting input coupled to the reference voltage ($+V_{REF}$) and powered only by the single supply voltage.

DETAILED DESCRIPTION OF THE PREFERRED EMBODIMENTS

Figures 1, 2:
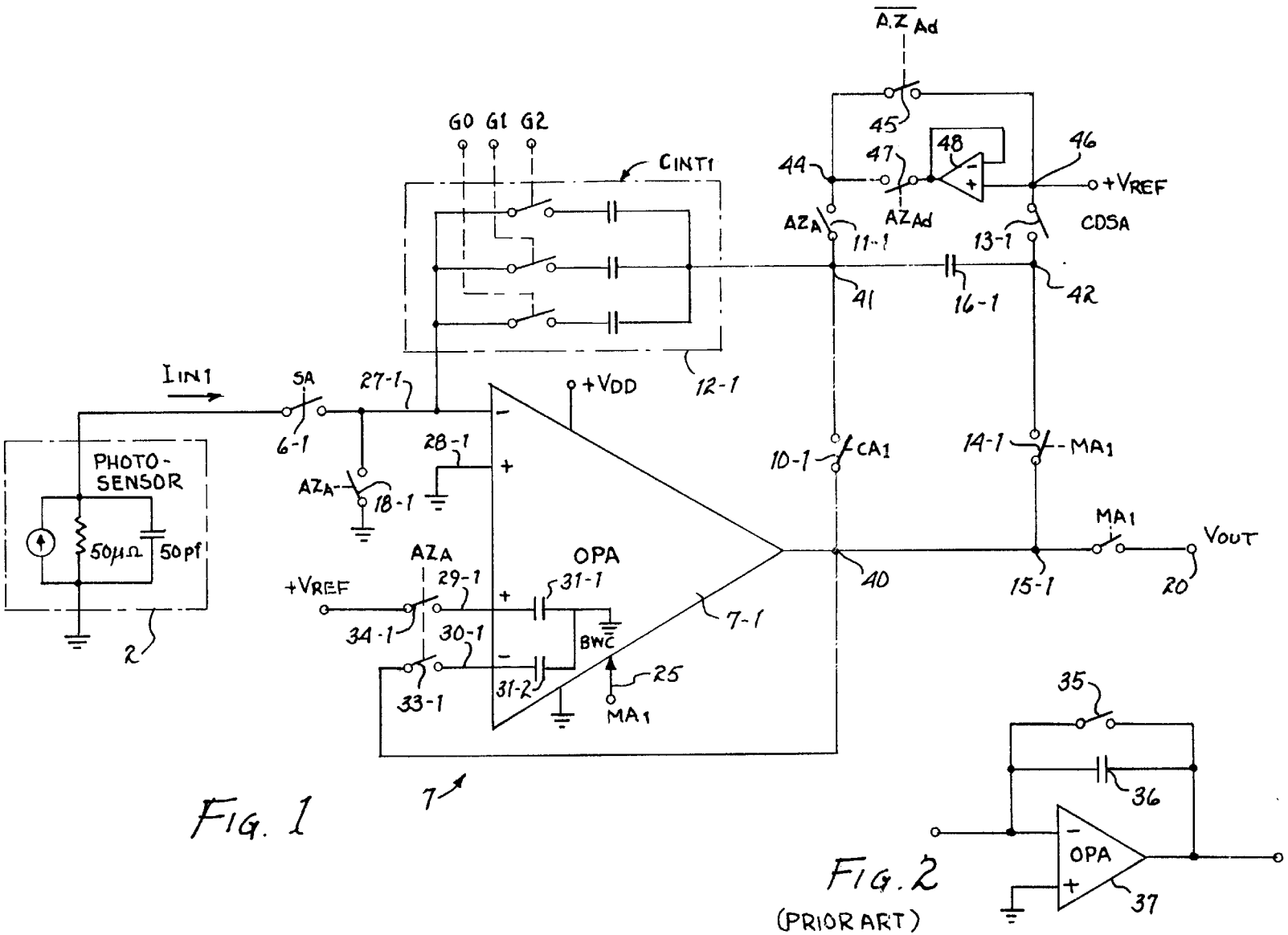
FIG. 2 (PRIOR ART)
FIG. 1 is a basic block diagram of the integrating current-to-voltage converter of the present invention.
FIG. 2 is a circuit diagram useful in explaining the prior art.
Figures 5, 5A:
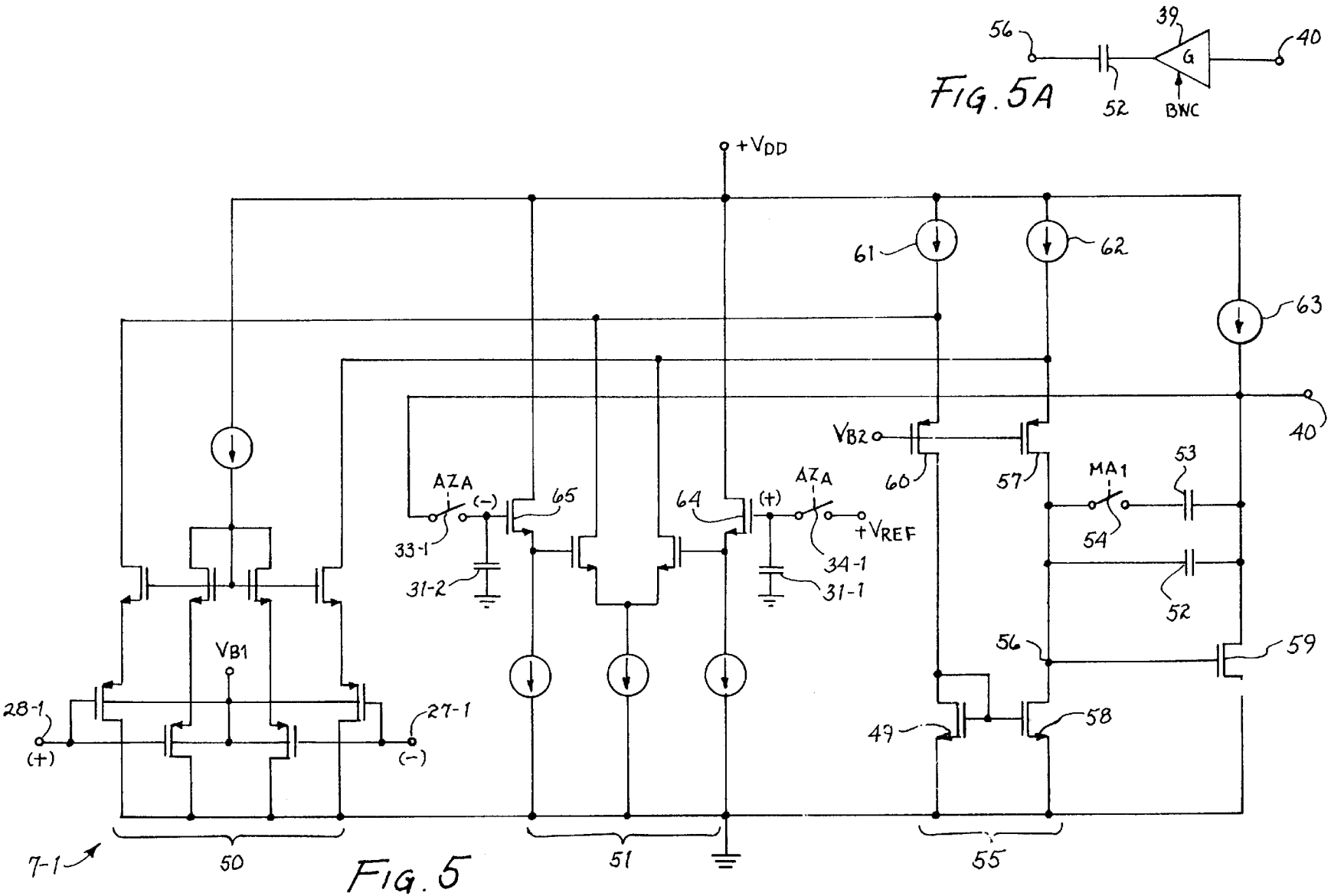
FIG. 5 is a schematic diagram of the operational amplifier included in FIG. 1.
FIG. 5A is a schematic diagram of an alternative bandwidth control circuit for the operational amplifier of FIG. 5A.

Referring to FIG. 1, current-to-voltage integrator 7 includes an operational amplifier 7-1, which is shown in more detail in FIG. 5. Operational amplifier 7-1 includes an inverting (–) input connected to conductor 27-1, and a non-inverting (+) input connected by conductor 28-1 to ground (or other suitable bias voltage conductor in which case the "virtual ground" referred to hereinafter would be equal to that bias voltage. In the described embodiment, operational amplifier 7-1 also includes an auto-zeroing stage having an inverting auto-zeroing input (–) connected to conductor 30-1 and a non-inverting auto-zeroing input (+) connected to conductor 29-1. These two auto-zeroing inputs are connected internally to auto-zeroing capacitors 31-1 and 31-2, respectively. As later explained in more detail with respect FIG. 5, a bandwidth control conductor 25 of operational amplifier 7-1 is connected to receive an input $MA_1$ to change the amount of internal compensation capacitance and hence the bandwidth thereof.

Inverting input conductor 27-1 is coupled by switch 8-1 (controlled by signal $AZ_A$) to ground. Conductor 27-1 also is coupled by sampling switch 6-1 (controlled by sample signal SA) to an external photosensor 2 (which has the equivalent circuit shown within the dotted lines). Conductor 27-1 is further connected to a programmable capacitor array 12-1 which functions as an integrating capacitor having a capacitance $C_{INT1}$. A digital code including gain select inputs G0, G1 and G2 selects the absolute value of $C_{INT}$ and hence the gain of current-to-voltage integrator 7. More details of capacitor array 12-1 are set forth in the above incorporated-by-reference commonly assigned Todsen et al. application.

Capacitor array 12-1 includes a plurality of binarily weighted capacitors which allow a user to adjust the gain of current-to-voltage integrator 7 by selecting G0,G1,G2 to adjust the value of $C_{INT1}$ Capacitor array 12-1, hereinafter also referred to as "integrating capacitor $C_{INT1}$", is coupled between the inverting input and the output of operational amplifier 7-1 by switch 10-1 (controlled by signal $CA_1$); which is coupled between conductors 40 and 41.

The output of operational amplifier 7-1 is connected by conductor 40 to one terminal of auto-zeroing switch 33-1, the other terminal of which is connected to conductor 30-1. Conductor 29-1 is coupled by auto-zeroing switch 34-1 to $+V_{REF}$. Both switches 33-1 and 34-1 are controlled by auto-zeroing signal $AZ_A$. Non-inverting unity gain buffer 48 allows coarse but rapid partial precharging of $C_{INT1}$ to nearly $+V_{REF}$ volts without overloading a precision voltage reference circuit (not shown) supplying $+V_{REF}$ while switches 47 and 11-1 are closed and switch 45 is open. Then switch 47 is opened, and switch 45 then is closed. This allows the last bit of "fine" precharging of $C_{INT1}$ precisely to $+V_{REF}$ without disturbing the precision reference voltage circuit, because very little additional charge is needed to finish precharging $C_{INT1}$.

Operational amplifier output 40 is coupled by switch 10-1 (controlled by signal $CA_1$) to conductor 41, which is connected to one terminal of integrating capacitor $C_{INT1}$ and to one plate of CDS (correlated double sampling) capacitor 16-1, the other plate of which is connected to conductor 42. Conductor 41 is coupled by switch 11-1 (controlled by auto-zeroing signal $AZ_A$) to conductor 44. Conductor 44 is coupled by switch 45 (controlled by signal $\overline{AZ}_{Ad}$) to conductor 46, which receives reference voltage $+V_{REF}$. Conductor 44 also is coupled by switch 47 (controlled by the signal $AZ_{Ad}$) to the output and inverting input of a unity gain buffer 48. The non-inverting input of buffer 48 is connected by conductor 46 to $V_{REF}$, and the inverting input is connected to the output thereof. Conductor 46 is connected by switch 13-1 (controlled by correlated double sampling signal $CDS_A$) to conductor 42. Conductor 42 is coupled by switch 14-1 (controlled by measurement signal $MA_1$) to operational amplifier output conductor 40. Operational amplifier output conductor 40 is coupled by switch 15-1 (also controlled by measurement signal $MA_1$) to integrator output conductor 20.

Figure 4:
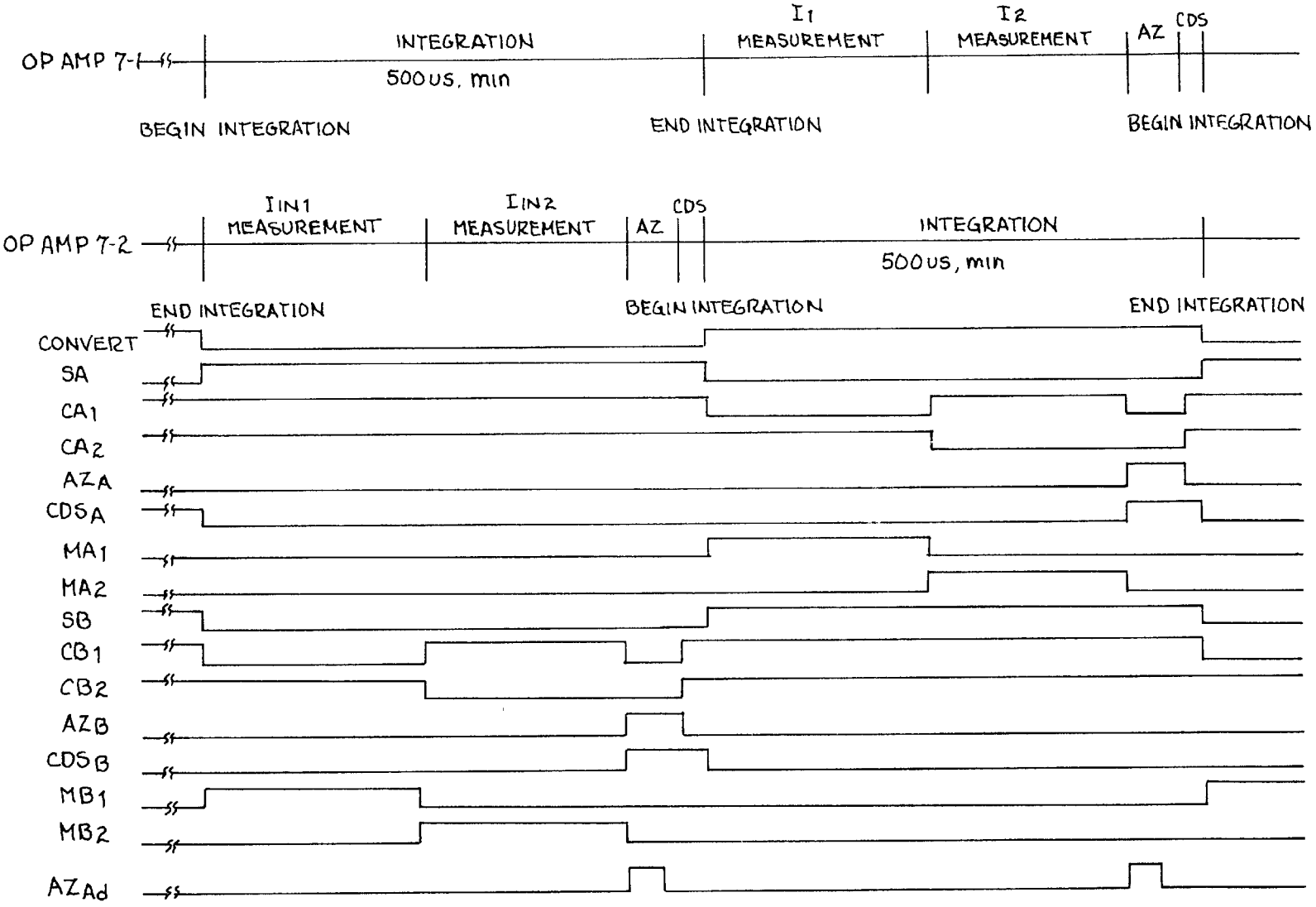
FIG. 4 is a timing diagram for the analog-to-digital converter of FIG. 3.

FIG. 4 shows a timing diagram of the above mentioned signals which control the various switches in FIG. 1.

FIGS. 1A, 1B, 1C, and 1D show simplified equivalent circuits that are useful in describing the operation of the current integrating circuit 7 of FIG. 1 for the precharge/auto-zero, correlated double sampling, integration, and hold-for-measurement modes of operation, respectively, thereof.

Figure 1A:
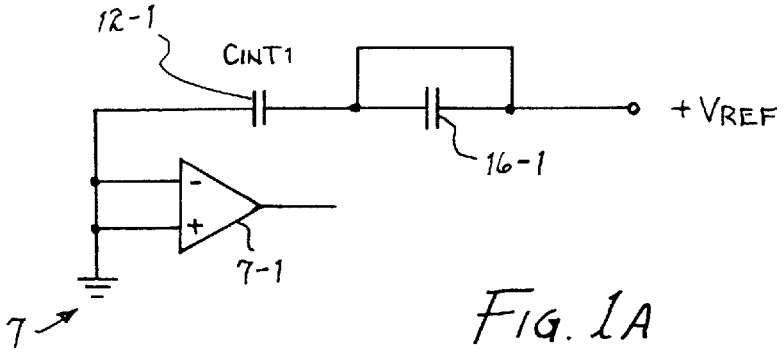
FIGS. 1A–1D are simplified equivalent circuits useful in explaining the operation of the integrating amplifier of FIG. 1.

As shown by the equivalent circuit of FIG. 1A, during the precharge/auto-zero operation integrating capacitor 12-1 is precharged to $+V_{REF}$ volts and CDS capacitor 16-1 is short-circuited or reset to zero volts. The inverting and non-inverting inputs are set to ground. This is accomplished by opening switch 6-1 and closing switches 8-1, 11-1, 13-1, and 45, thereby precharging integrating capacitor 12-1 to $+V_{REF}$ and discharging CCD capacitor 16-1 to zero volts. Although not shown in FIG. 1A, auto-zeroing of operational amplifier 7-1 is occurring at the same time as the precharging of $C_{INT1}$ to $+V_{REF}$, i.e., when switches 33-1 and 34-1 are closed, to provide feedback to stabilize operational amplifier 7-1 while $C_{INT1}$ is disconnected during the precharging operation, and also to set conductor 40 to $+V_{REF}$, which is the same voltage to which $C_{INT1}$ is being precharged. Then both will be at the same voltage $+V_{REF}$ when switch 10-1 is closed to start the next integration.

Figure 1B:
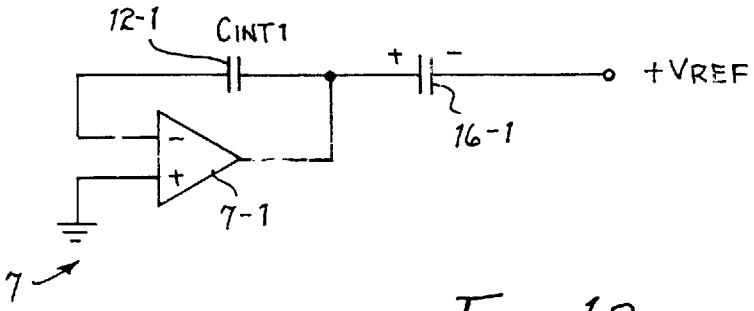
Figure 1C:
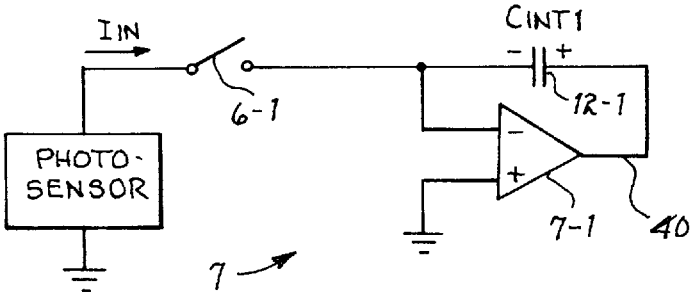

Next, referring to the equivalent circuit of FIG. 1B, with switches 8-1 and 11-1 opened, switch 10-1 closed, switch 6-1 remaining open, and switches 13-1 and 45 remaining closed, the kT/C noise and charge injection noise produced by operating the various switches are stored on both integrating capacitor $C_{INT1}$ and CDS capacitor 16-1; note these stored noise voltages are of opposite polarity on integrating capacitor $C_{INT1}$ and CDS capacitor 16-1. (Those skilled in the art know that operatively disconnecting a capacitor from a circuit by opening a switch produces charge injection errors and kT/C errors (also referred to as "reset errors") in a voltage which is stored on the capacitor. The opening of switches 8-1 and 11-1 and keeping switch 13-1 closed results in nearly equal but opposite polarity error voltage to be stored on integrating capacitor $C_{INT1}$ and "correlated double sampling" capacitor 16-1. Note that decoupling CDS capacitor 16-1 from $+V_{REF}$ also produces a kT/C error voltage on it which is not cancelled, but the size of CDS capacitor 16-1 is made large enough, e.g. 200 picofarads, that such error voltage is negligible.)

Integrating circuit 7 then is ready to begin integrating the input photocurrent $I_{IN1}$ when switch 6-1 is closed. Referring to the equivalent circuit in FIG. 1C, switches 8-1 and 11-1 remain open, and switch 10-1 remains closed. CDS capacitor 16-1 is disconnected from $+V_{REF}$ by opening switch 13-1. Operational amplifier 7-1 decreases its output voltage on conductor 40 from the initial $+V_{REF}$ voltage (to which integrating capacitor $C_{INT1}$ is precharged) as necessary to cause integrating capacitor $C_{INT1}$ to balance the input photocurrent $I_{IN1}$ to maintain the inverting input conductor 27-1 at a virtual ground voltage.

Figure 1D:
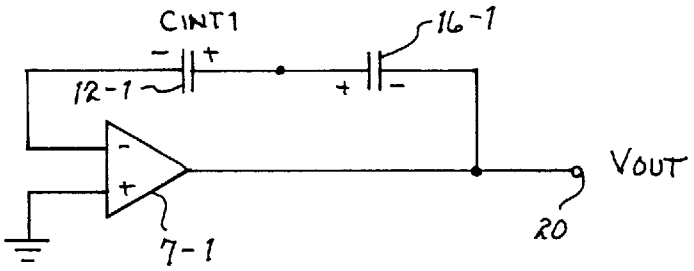
Figure 3:
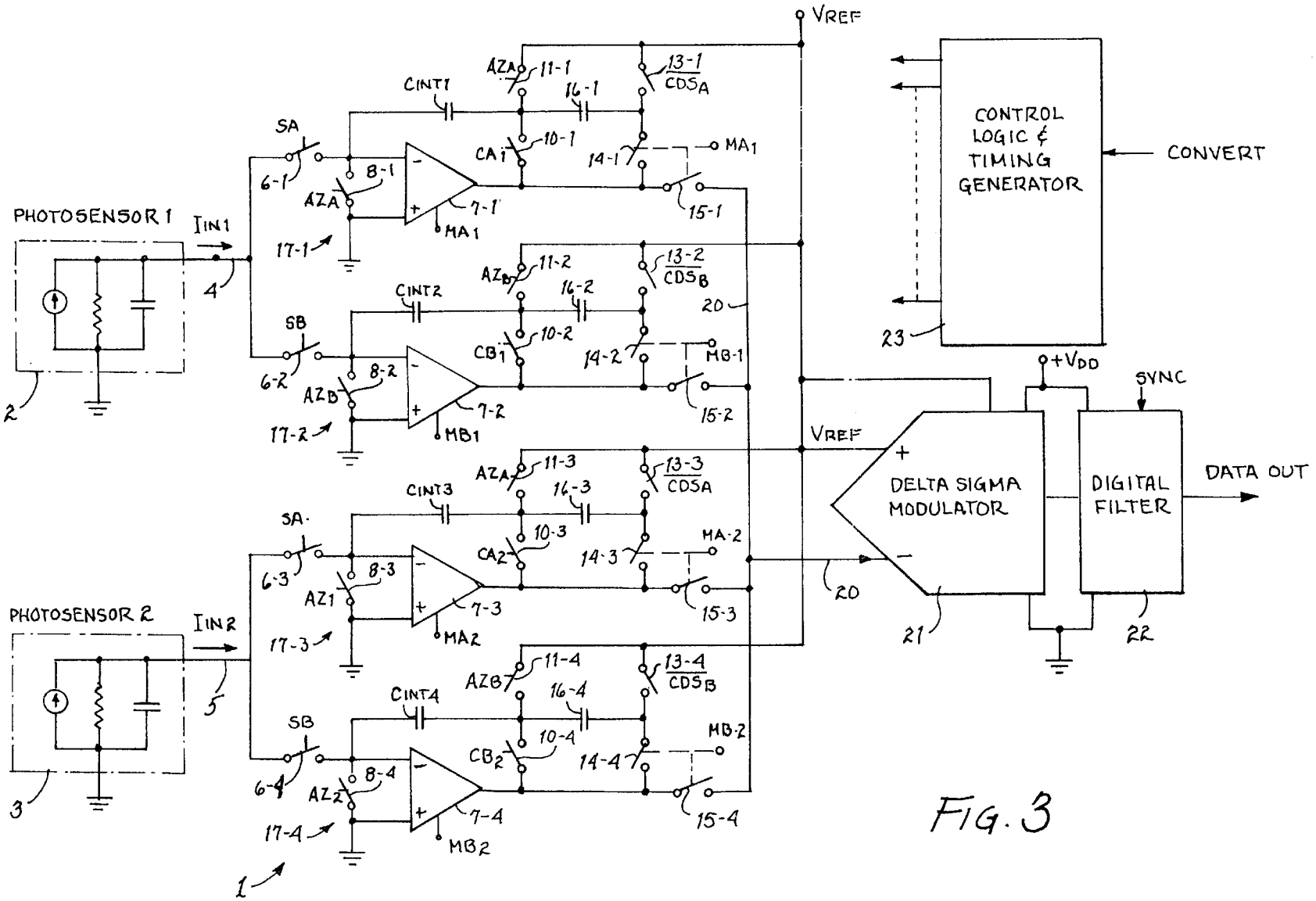
FIG. 3 is a detailed schematic diagram of a dual-channel continuously integrating analog-to-digital converter including correlated double sampling capacitors operative to cancel kT/C switching errors and charge injection errors and operable from a single power supply.

After the foregoing integration cycle is complete, integrating circuit 7 has the equivalent circuit shown in FIG. 1D. Switch 10-1 is opened and switch 14-1 is closed to incorporate CDS capacitor 16 into the feedback loop with integrating capacitor 12-1. This causes the opposite polarity kT/C error voltages and also charge injection error voltages stored earlier on both integrating capacitor 12-1 and CDS capacitor 16-1 to automatically cancel. Input switch 6-1 is opened. Switch 8-1 remains open. Switch 11-1 remains open. Switch 13-1 remains open, and switch 15-1 is closed to apply the integrated output voltage of operational amplifier 7-1 to the input of another circuit (for example a delta-sigma modulator 21 as shown in FIG. 3). The bandwidth control signal $MA_1$ is applied to open switch 54 of FIG. 5 to increase the bandwidth of operational amplifier 7-1 and thereby decrease its settling time immediately prior to sampling of the output of the integrator by, for example, the input of an analog-to-digital converter. During the operations corresponding to the equivalent circuit of FIGS. 1A–C the bandwidth of the operational amplifier is set to a low value (switch 54 closed) to improve noise performance during the above-mentioned precharge/auto-zero, correlated double sampling, and (input signal) integration operations.

Referring next to FIG. 5, operational amplifier 7-1 includes a differential input stage 50 connected to a folded cascode stage 55, including constant current sources 61 and 62 connected to the sources of P-channel cascode MOSFETs 60 and 57, respectively. Their drains are connected to gate and drain of N-channel MOSFET 49 and the drain of N-channel MOSFET 58, respectively. The sources of MOSFETs 49 and 58 are connected to ground. The gates of MOSFETs 49 and 58 are connected together so they form a current mirror. The drain of current mirror output MOSFET 58 is connected by conductor 56 to the gate of N-channel MOSFET 59, which is connected as a common source amplifier. The differential input stage 50 of operational amplifier 7-1 is more fully described in commonly assigned U.S. Pat. No. 4,901,031 (Kalthoff et al.).

Operational amplifier 7-1 also includes a differential auto-zeroing stage 51 which includes the above mentioned auto-zeroing capacitors 31-1 and 31-2 connected between ground and the (+) and (−) auto-zeroing inputs, respectively. The (−) input is connected to the gate of N-channel source follower MOSFET 65, and the (+) input is connected to the gate of N-channel source follower MOSFET 64. The source followers drive the gates of a pair of source-coupled N-channel MOSFETs. Above mentioned switch 33-1 couples output conductor 40 to the inverting input (+) of auto-zeroing stage 51, and switch 34-1 couples $V_{REF}$ to the non-inverting input (−) of auto-zeroing stage 51. The auto-zeroing technique is described generally in above mentioned U.S. Pat. No. 5,027,116 (Armstrong et al.). The output of the operational amplifier 7-1 is fed back to an inverting input of an auto-zeroing stage 51 thereof also having a non-inverting input coupled to the reference voltage to stabilize the operational amplifier during the precharging and to cause the output 4 of the operational amplifier output to be at the reference voltage at the beginning of the integration cycle. Therefore, as can be seen by referring to FIG. 5, the disconnected output 40 of operational amplifier 7-1 is forced to be equal to the $+V_{REF}$ voltage being applied to the (+) input of auto-zeroing stage 51 during the auto-zeroing operation. (This single-ended feedback to the auto-zeroing input is in contrast to the above-mentioned U.S. Pat. No. 5,027,116 by Armstrong et al. wherein a differential output is fed back to differential auto-zeroing inputs.)

Conductor 25 conducts bandwidth control signal $MA_1$ that controls a switch 54 coupled between one plate of a compensation capacitor 53 and conductor 56. Conductor 56 is connected to the drains of MOSFETs 57 and 58. The other plate of compensation capacitor 53 is connected to output conductor 40. Compensation capacitor 52 is connected between conductors 56 and 40 and may have a capacitance of approximately 30 picofarads, much smaller than compensation capacitor 53 which may have a capacitance of approximately 200 picofarads. Thus, the bandwidth of operational amplifier 7-1 can be considerably reduced by turning on switch 54. As subsequently explained, this can be advantageous when integrating amplifier 7-1 is used as a front end integrator of a delta-sigma analog-to-digital converter.

Alternatively, as shown in FIG. 5A, capacitor 53 and switch 54 can be omitted, and a gain stage 39 can be coupled between output 40 and the right terminal of capacitor 52. The effective value of compensation capacitor 52 then is multiplied by the gain G of gain stage 39, which can be controlled by gain control input BWC to thereby control the bandwidth of operational amplifier 7-1.

Referring next to FIG. 3, a two-channel (i.e., "channel 1" and "channel 2" analog-to-digital converter 1 receives two photocurrents $I_{IN1}$ and $I_{IN2}$ as analog inputs via input conductors 4 and 5, respectively. $I_{IN1}$ and $I_{IN2}$ are produced by two photodiodes which are modeled as shown by the equivalent circuits within dotted lines 2 and 3, respectively.

In "channel 1", first and second switched capacitor integrators 17-1 and 17-2 are multiplexed to alternately sample photosensor 1 and also to alternately provide a continuous integrate/hold function to thereby produce a first analog output voltage which represents the sensed photocurrent $I_{IN1}$. Similarly, in "channel 2" third and fourth switched capacitor integrators 17-3 and 17-4 are multiplexed to alternately sample photosensor 2 and also to alternately provide a continuous integrate/hold function to produce a second analog output voltage which represents the sensed photocurrent $I_{IN2}$.

For the purpose of understanding the labels used for the switch control signals in the circuit of FIG. 3 and the timing diagram thereof shown in FIG. 4, it will be helpful to note that integrators 17-1 and 17-3 can be thought of as each forming an "A" circuit path, and integrators 17-2 and 17-4 can be thought of as forming a "B" circuit path. Accordingly, in the switch control signals, "A" corresponds to integrators 17-1 and 17-3, and "B" corresponds to integrators 17-2 and 17-4. Also, the numerals "1" and "2" correspond to above mentioned "channel 1" and "channel 2", respectively.

Two analog output voltages, one for "channel 1" and one for "channel 2", are multiplexed onto conductor 20 and alternately applied to the inverting (–) input of a differential delta-sigma modulator 21, the (+) input of which is connected to $+V_{REF}$. The output of delta-sigma modulator 21 is coupled to the input digital filter 22, which together form a delta-sigma analog-to-digital converter that produces a digital signal output DATA OUT that alternately represents the two input photocurrents $I_{IN1}$ and $I_{IN2}$. Like the current-to-voltage integrators 7-1,2,3,4, the delta-sigma analog-to-digital converter is powered only by the single power supply providing $+V_{DD}$ and ground. (Note that any type differential analog-to-digital converter could be used; it does not have to be of the delta-sigma type. Note also that the $+V_{REF}$ voltage to which the integrating capacitor 12-1 is precharged must also be the reference voltage against which the analog-to-digital converter 21 measures the output voltage produced by the integrator 7. Conventionally, if an analog-to-digital converter measures an input voltage relative to ground, it is considered to be a single-ended analog-to-digital converter, and if the analog-to-digital converter measures the input voltage relative to a voltage or signal other than ground, then it is considered to be a differential analog-to-digital converter.)

Most of the following explanation is directed to switched capacitor integrators 17-1 and 17-2, because the circuitry including switched capacitor integrators 17-3 and 17-4 is identical to integrators 17-1 and 17-2 except for differences in several of the control signals that achieve the multiplexing of the two sampled and held analog voltage signal produced by integrators 17-1 and 17-2 and the sampled and held analog voltage signal produced by integrators 17-3 and 17-4, which are alternatively applied via conductor 20 to the inverting input of delta-sigma modulator 21.

As explained above, an important aspect of the invention involves "precharging" each of the four integrating capacitors $C_{INT1,2,3,4}$ in FIG. 3 to a fixed reference voltage $+V_{REF}$ at the beginning of each integrating cycle and then integrating the input photocurrents $I_{IN1}$ and $I_{IN2}$ so that the operational amplifiers 7-1,2,3,4 gradually discharge the various integrating capacitors downward from $+V_{REF}$ volts toward ground proportionately to the amount of charge supplied by $I_{IN1}$ and $I_{IN2}$, and then using a differential analog-to-digital converter with its non-inverting input connected to $+V_{REF}$ to alternatively measure the resulting voltages held on the integrating capacitors $C_{INT1,2,3,4}$.

Note that the above-described technique of precharging the integrating capacitors $C_{INT1,2,3,4}$ to $+V_{REF}$ volts necessitates physically removing them from the feedback loops of the corresponding integrating amplifiers, respectively. This would ordinarily cause instability in the integrating amplifiers. In accordance with the present invention, integrating amplifiers 7-1,2,3,4 each are provided with the separate internal negative feedback path to the (–) input of autozeroing stage 51 as shown in above-described FIG. 5 maintains stability of operational amplifier 7-1 while the integrating capacitors are being precharged to $+V_{REF}$.

Still referring to FIG. 3, operational amplifier 7-1 includes a control input $MA_1$, and operational amplifier 7-2 includes a control input $MB_1$. These control inputs operate to reduce the bandwidth of the operational amplifiers while they are in their above-described integration mode and to increase their bandwidth while they are in their hold or measurement mode. The reduced bandwidth during the integration mode reduces the RMS noise generated by the operational amplifiers and consequently stored on the integration capacitors $C_{INT1,1,3,4}$. The increased bandwidth during the measurement mode, during which the operational amplifier outputs are connected to the (–) input of delta-sigma modulator 21, provides faster settling and hence faster analog-to-digital conversion times for each analog-to-digital conversion cycle. The internal mechanism for increasing and decreasing the bandwidth of the operational amplifier is simply to switch in more or less internal compensation capacitance in response to $MA_1$ or $MB_1$.

The above described integrator can be operated from a single power supply, and thus can be used as a front-end integrator with a single-supply analog-to-digital converter. The described structure and technique for including the CDS capacitor in the integrator feedback loop after the integration results in a very accurate output voltage for sampling by, for example, the input of an analog-to-digital converter. The bandwidth the control capability of the operational amplifier results in both good noise performance and fast settling times during sampling of the integrator contact voltage by the input of an analog-to-digital converter, with the result of fast overall conversion of the input photocurrent to a digital number. The programmable integrating capacitor allows "on-the-fly" gain modification, which may be very helpful to some users.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, if the non-inverting input of operational amplifier 7-1 is connected to a bias voltage other than ground, then the "virtual ground" referred to will be equal to that bias voltage, and $C_{INT1}$ should be precharged to the difference between $+V_{REF}$ and a bias voltage. Also, other circuitry than that disclosed could be provided to precharge $C_{INT1}$ as long as $+V_{REF}$ appears across it at the beginning of the integration cycle. The principles of the invention are equally applicable to an integrator in which the input current flows out of the inverting input of the operational amplifier so its output voltage increases during integration. Also, it is not necessary that CDS capacitor 16-1 be reset.

What is claimed is:

1. An integrating circuit comprising in combination:

(a) an operational amplifier having an inverting input, an output, and a non-inverting input coupled to a first reference voltage conductor conducting a first reference voltage, the operational amplifier being powered by a first supply voltage applied thereto by a first supply voltage conductor and a second supply voltage applied thereto by a second supply voltage conductor;

(b) an integrating capacitor having a first terminal coupled to the inverting input and a second terminal coupled to the output;

(c) first switching circuitry coupled between the output and the second terminal and operative to decouple the output from the integrating capacitor during precharging of the integrating capacitor;

(d) a first conductor conducting a precise second reference voltage;

(e) second switching circuitry coupled between the first conductor and the second terminal and operative to couple the second terminal to the second reference voltage during the precharging; and (f) third switching circuitry coupled between the second supply voltage conductor and the first terminal and operative to couple the first terminal to the first reference voltage conductor during the precharging, the precharging occurring before each integration cycle, each integration cycle including decoupling the first terminal from the first reference voltage conductor, decoupling the second terminal from the second reference voltage, coupling the output to the second terminal, and conducting an input current into or out of the inverting input, the operational amplifier adjusting its output voltage from the second reference voltage as necessary to maintain the inverting input at a voltage equal to the first reference voltage.

2. The integrating circuit of claim 1 wherein the first reference voltage conductor is the second supply voltage conductor and the first reference voltage is the second supply voltage.

3. The integrating circuit of claim 1 further including:

a correlated double sampling capacitor having a third terminal coupled to the second terminal and also having a fourth terminal;

fourth switching circuitry coupled between the fourth terminal and the first conductor and operative to measure reset errors of the integrating capacitor by performing correlated double sampling of the reset errors on the correlated double sampling capacitor prior to the integration cycle; and fifth switching circuitry coupled between the fourth terminal and the output and operative to couple the correlated double sampling capacitor in series with the integrating capacitor after the integration cycle to cancel opposite polarity reset error voltages stored on both the integrating capacitor and the correlated double sampling capacitor and thereby cause the operational amplifier to produce an output voltage that more accurately represents the input current.

4. The integrating circuit of claim 1 wherein the operational amplifier includes a first internal compensation capacitor coupled between the output and a point in an internal signal path of the operational amplifier.

5. The integrating circuit of claim 4 wherein the operational amplifier includes a second internal compensation capacitor and fourth switching circuitry coupled in series between the output and a point in the internal signal path, to reduce bandwidth of the operational amplifier when the fourth switching circuitry is operative to couple the second compensation capacitor in parallel with the first compensation capacitor.

6. The integrating circuit of claim 4 including a gain stage having an input coupled to the output and an output coupled to one terminal of the first compensation capacitor, the gain stage having a gain control input to thereby control the bandwidth of the operational amplifier by multiplying the effective value of the first compensation capacitor by the gain of the gain stage.

7. The integrating circuit of claim 1 wherein the integrating capacitor includes a programmable array of capacitors which can be selectively coupled in parallel in response to a plurality of gain selection inputs to thereby control gain of the integrating circuit.

8. The integrating circuit of claim 1 wherein the operational amplifier includes a differential auto-zeroing stage including an inverting input and a non-inverting input and differential outputs coupled to corresponding outputs of a differential input stage of the operational amplifier.

9. The integrating circuit of claim 8 wherein the output is coupled to the inverting input of the auto-zeroing stage to stabilize the operational amplifier while the first switching circuit decouples the output from the integrating capacitor.

10. The integrating circuit of claim 9 wherein the non-inverting input of the auto-zeroing stage is coupled to the first conductor to cause the output of the operational amplifier to be at the second reference voltage at the end of the precharging of the integrating capacitor.

11. The integrating circuit of claim 3 having the output coupled to one input of a differential analog-to-digital converter having another input coupled to the second reference voltage.

12. The integrating circuit of claim 11 wherein the analog-to-digital converter includes a delta-sigma modulator having an output coupled to an input of a digital filter.

13. The integrating circuit of claim 2 wherein the second switching circuitry includes:

i. a first conductor conducting the second reference voltage;

ii. a buffer circuit having an input connected to the first conductor and also having an output;

iii. a first switch controlled by a first signal and coupled between the output of the buffer circuit to a second conductor to allow the buffer circuit to rapidly precharge the integrating capacitor nearly to the reference voltage without overloading a precise reference voltage source which generates the reference voltage;

iv. a second switch coupled between the first conductor and the second conductor, controlled by a second signal delayed from the first signal to finish precharging the integrating capacitor precisely to the reference voltage; and v. a third switch coupled between the second conductor and the second terminal and operative to coupled the second conductor to the second terminal while either of the first and second switches is closed.

14. A method of operating an integrating circuit, comprising the steps of:

(a) providing an operational amplifier having an inverting input, an output, and a non-inverting input coupled to a first reference voltage conductor conducting a first reference voltage, and powering the operational amplifier from a supply voltage applied thereto by a first supply voltage conductor and a second supply voltage applied thereto by a second supply voltage conductor;

(b) providing an integrating capacitor having a first terminal coupled to the inverting input, the integrating capacitor also having a second terminal coupled to the output;

(c) precharging the integrating capacitor to a second reference voltage by coupling the first terminal of the integrating capacitor to the first reference voltage and decoupling the output from the second terminal of the integrating capacitor and coupling the second terminal of the integrating capacitor to a precise second reference voltage conductor conducting the second reference voltage;

the precharging occurring before each integration cycle, each integration cycle including decoupling the first terminal from the first reference voltage conductor, decoupling the second terminal from the second reference voltage, coupling the output to the second terminal, and conducting an input current into or out of the inverting input, the operational amplifier adjusting its output voltage from the second reference voltage as necessary to maintain the inverting input at a voltage equal to the first reference voltage.

15. The method of claim 14 including providing the first reference voltage equal to the second supply voltage.

16. The method of claim 14 including:

i. providing a correlated double sampling capacitor;

ii. coupling the correlated double sampling capacitor to the integrating capacitor to measure a reset error of the integrating capacitor by performing a correlated double sampling of the reset error on the correlated double sampling capacitor prior to a next integration cycle; and iii. coupling the correlated double sampling capacitor in series with the integrating capacitor after the integration cycle to cancel opposite polarity reset error voltages stored on both the integrating capacitor and the correlated double sampling capacitor and thereby cause the operational amplifier to produce an output voltage that more accurately represents the input current.

* * * * *